US005231709A

United States Patent [19]

Miller

[11] Patent Number: 5,231,709

[45] Date of Patent: Aug. 3, 1993

[54] SUPPORT DECK FOR MATTRESS OR SEAT

[76] Inventor: John E. Miller, 1016 Monroe St., Tupelo, Miss. 38801

[21] Appl. No.: 588,351

[22] Filed: Sep. 26, 1990

[51] Int. Cl.[5] ..... A47C 17/02

[52] U.S. Cl. ..... 5/13; 5/188; 5/261

[58] Field of Search ..... 5/12.1, 13, 14, 188, 5/186.1, 192, 259.1, 270, 261, 278; 245/1, 5, 9; 297/452

[56] References Cited

U.S. PATENT DOCUMENTS

| | | | |
|---|---|---|---|
| 1,259,315 | 3/1918 | Tandy | 5/188 |
| 1,447,294 | 3/1923 | Cole | 5/188 |
| 2,742,653 | 4/1956 | Woller | 5/13 |
| 2,851,698 | 9/1958 | Barabas | 5/13 |
| 3,296,632 | 1/1967 | Hoffman | 5/13 |
| 3,380,082 | 4/1968 | Mikos | 5/13 |
| 3,733,625 | 5/1973 | Platt | 5/188 |
| 4,435,014 | 3/1984 | Gilardi | 297/452 |
| 4,523,342 | 6/1985 | Poovey | 5/12.1 |

*Primary Examiner*—Peter M. Cuomo
*Assistant Examiner*—Flemming Saether
*Attorney, Agent, or Firm*—William E. Mouzavires

[57] ABSTRACT

A support deck for a sofa bed having a plurality of wires arranged in a grid and being interconnected at grid intersections such that when a force is applied to one side of the deck the deck will yield but when a force is applied to the opposite side the deck will be relatively unyieldable.

15 Claims, 5 Drawing Sheets

SUPPORT DECK FOR MATTRESS OR SEAT

BACKGROUND OF THE INVENTION

The present invention generally relates to method and apparatus for providing a support deck for a mattress or a seat. The support deck of the present invention is particularly suitable for use in sofa beds although the invention need not be limited thereto. In the past, sofa bed mattress decks have been made with link fabrics or polypropylene which are attached to an outside frame with hooks or helicals. The link fabric decks have an inherent flaw because they are comprised of a grid of wires which are free to pivot or yield thus offering little resistance when a person sits or rests on the unfolded sofa bed, this effect is known in the industry as "hammocking". The sofa bed decks made from polypropylene also suffer from the same inherent flaw in that they consist of a canvas-type material attached to a frame with hooks or helicals which simply are not resilient or strong enough to provide proper support for a person sitting or resting on the sofa bed.

Another problem with the prior art is what is known in the industry as "crowning". Crowning occurs when the sofa bed mattress, after having been folded and recessed back into the sofa, is so thick as to push upwards against the sofa bed deck causing a bulge because the sofa bed deck is not strong enough to restrain the compacted mattress. This bulge then makes it impossible for seat cushions to lay flat on the sofa, a condition known in the industry as cushion "smiling". Sitting on a sofa with "smiling" cushions is also unpleasant since one sits on a firm bulge of mattress almost teetering back and forth.

The present invention involves the use of a unique interlocking grid system in a support deck in order to eliminate mattress "hammocking", "crowning" and seat cushion "smiling" in sofa beds.

OBJECTS OF THE INVENTION

An object of the present invention is to provide a unique deck structure that may be used in sofa beds or other seating or bedding support systems.

Another object of the present invention is to provide a novel sofa bed mattress deck that eliminates the problem of "hammocking" identified above. Another object of the present invention is to provide a mattress deck that will also eliminate mattress "crowning" and cushion "smiling".

It is a further object of the present invention to provide a sofa bed mattress deck that can accommodate a thicker or longer sofa bed mattress yet at the same time provide for neat and compact storage or folding of the mattress back in the sofa bed.

It is another object of the present invention to provide a sofa bed mattress deck that when fully closed not only enables a sofa cushion to lay flat on it but also provides a flat and soft seat penetration as in a conventional sofa with standard sprung seats.

A further object of the present invention is to provide a sofa bed mattress deck that will achieve the above objects and yet is relatively inexpensive to manufacture.

SUMMARY OF THE INVENTION

The present invention is embodied in a grid attached to a frame, the grid being formed by wire-like members joined together such that the grid when pushed or forced from one side resists and maintains its flat surface (i.e. it is in the locked position) but when pushed or forced from the other side yields. As a result when the sofa bed is unfolded, a firm mattress is provided that contours to the user's body without excessive sagging. When folded and stored, the deck provides a flat surface upon which the sofa bed cushions can be placed without smiling or bulging upward. In this condition, the mattress is pushing upward and outward against the side of the deck that is in a locked position which resists the force of the mattress.

The support provided for a person sitting on the sofa bed when in the sofa mode simulates that of a standard sofa that has a sprung seat, due to the fact that the deck grid while locked against upward movement will yield in downward movement caused by the person's weight.

DRAWINGS

Other objects and advantages of the present invention will become apparent from the detailed description below taken in conjunction with the attached drawings in which.

DETAILED DESCRIPTION

Figure 1:
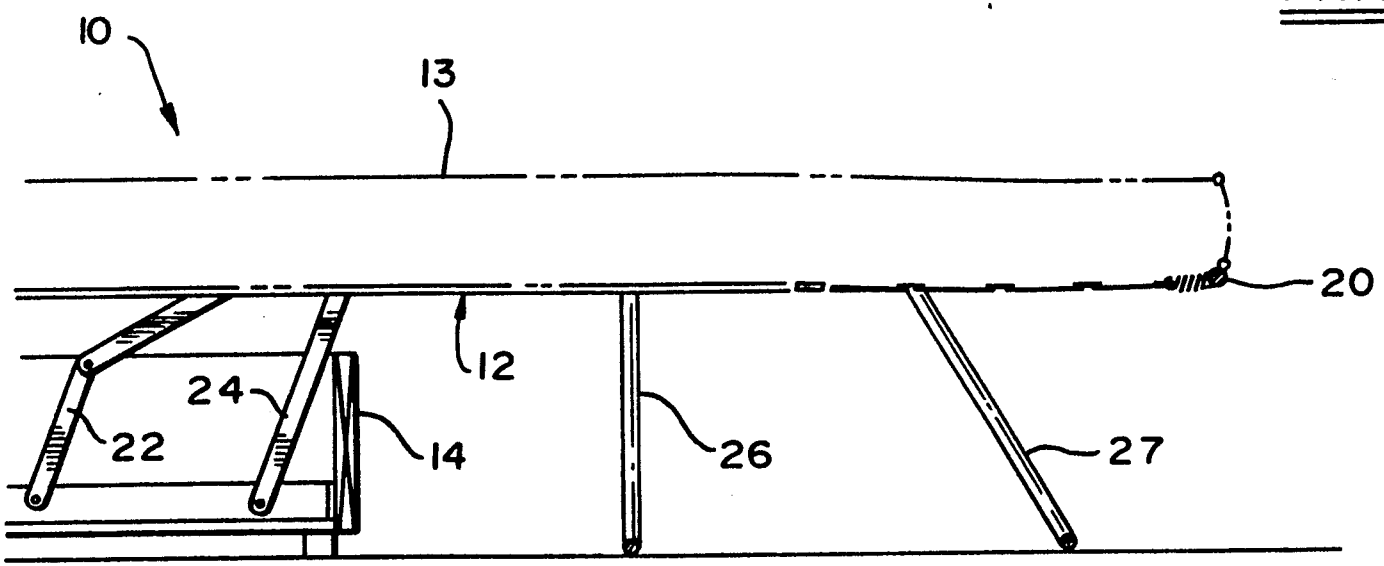
FIG. 1 is a side elevational view of a sofa bed in open position and incorporating a deck constituting a preferred embodiment of the present invention.
Figure 2:
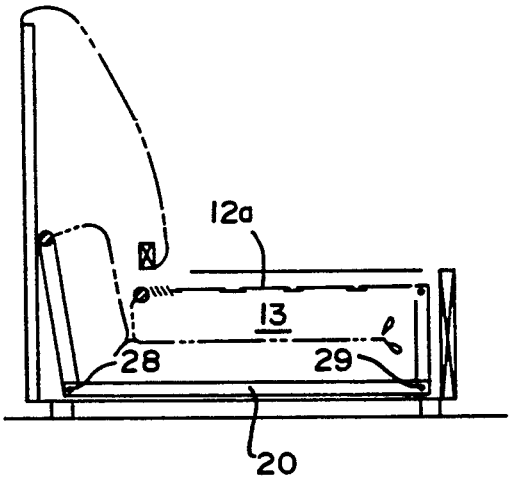
FIG. 2 is a side view of the sofa bed of FIG. 1 with portions removed to show internal parts.
Figure 5:
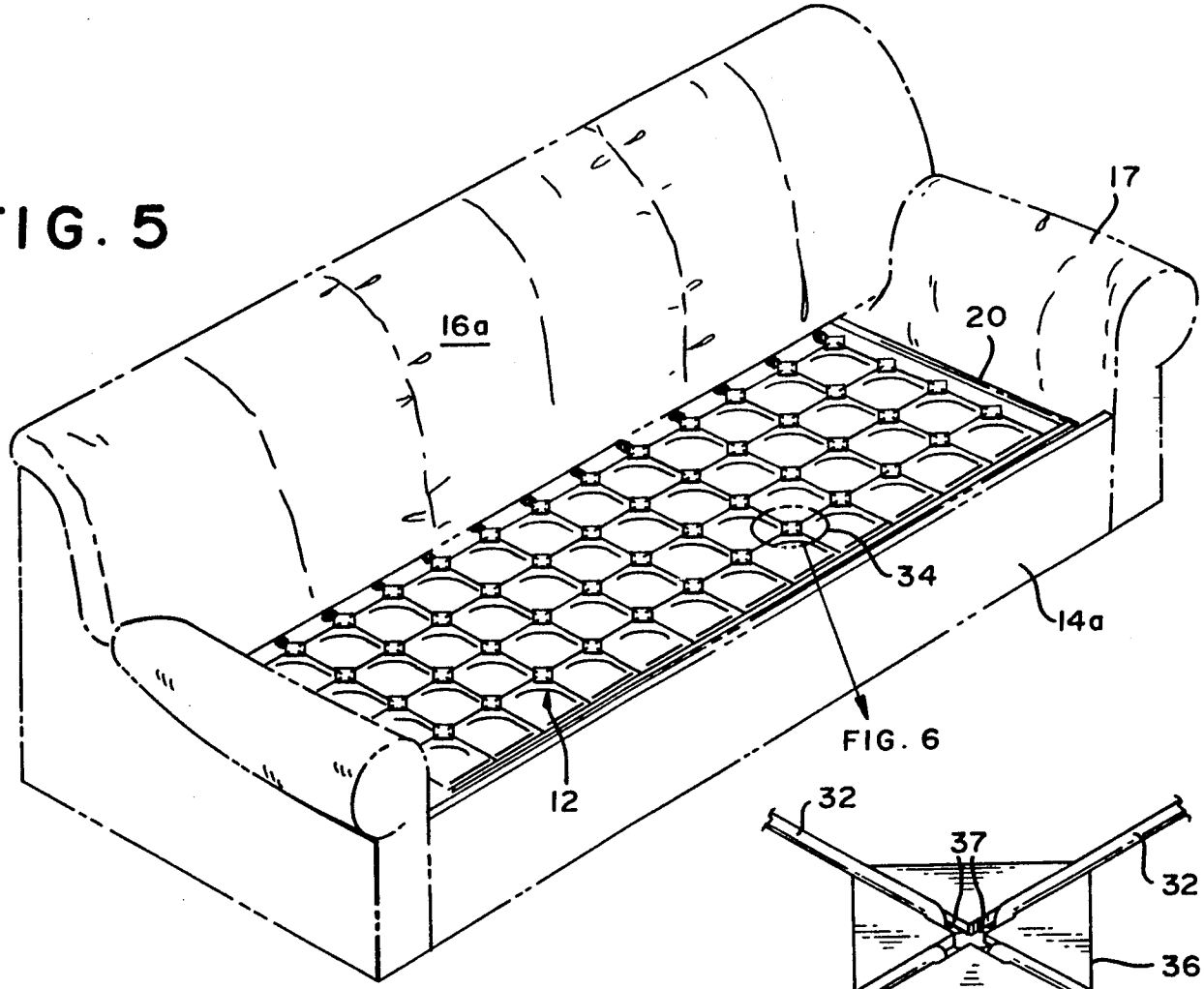
FIG. 5 is an enlarged perspective view of the sofa bed while in the sofa mode and with the cushions removed to show portions of the deck.
Figure 6:
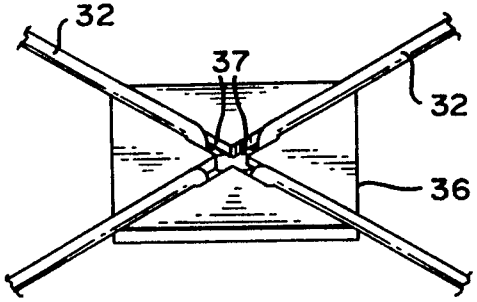
FIG. 6 is an enlarged fragmental perspective view of a portion of the bottom side of the deck when in the folded inverted position of FIG. 5.

Referring to the drawings in detail there is shown for illustrative purposes only in FIG. 1 a sofa bed generally designated 10 incorporating a support deck generally designated 12 in accordance with the present invention for supporting a mattress 13 for movement between a bed position shown in FIG. 1 and a sofa position shown in FIGS. 2 and 5. Sofa bed 10 may have a conventional frame structure including a backrest frame 16 upstanding from a base frame supported on the floor by legs 18, and a front rail 14. The aforementioned frame defines a cavity for receiving the sofa bed in the sofa position shown in FIG. 2 and for allowing the bed to be unfolded from the sofa position into the bed position shown in FIG. 1. Any conventional sofa bed frame may be utilized in conjunction with the deck of the present invention. In addition, the deck may be mounted to the frame by any suitable linkage shown for example at 22 and 24 for movement between the sofa and bed positions mentioned above. In addition, a conventional leg arrangement such as shown at 26 and 27 may be employed to support the deck in the bed position shown in FIG. 1 and yet at the same time to be foldable with the deck into the sofa position shown in FIG. 2. The mattress 13 itself may also be any conventional mattress although as will be apparent after reading the description below, the deck of the present invention will allow mattresses of greater depths to be employed than have been heretofore possible.

Figure 3:
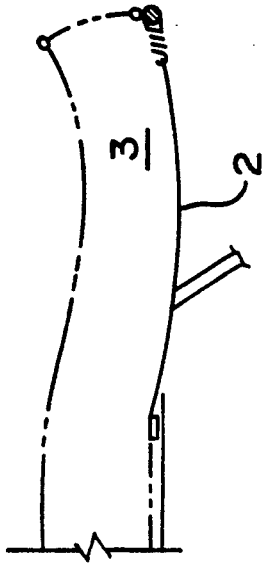
FIG. 3 PRIOR ART
FIG. 3 is a fragmental view of a mattress supported on a conventional deck and illustrating hammocking.
Figure 4:
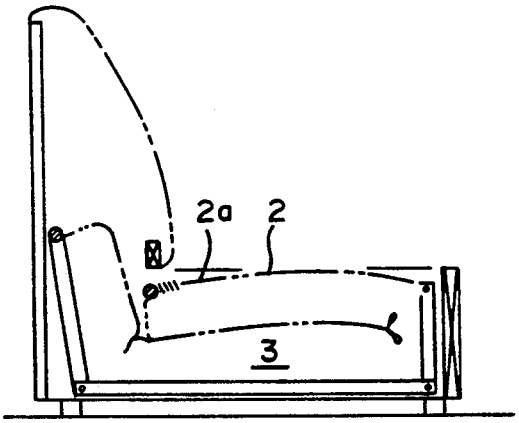
FIG. 4 PRIOR ART
FIG. 4 is a view generally similar to FIG. 2 but of a conventional sofa and deck illustrating the problem of "crowning"

FIG. 3 shows a conventional mattress 3 supported on a conventional deck 2 of the prior art and illustrates the problem of "hammocking" due to the fact that the deck 2 has insufficient strength to resist the weight of the mattress and an occupant of the mattress. FIG. 4 discloses the same conventional deck 2 when the sofa bed is in the folded or sofa position, and it is seen that due to the inadequate strength of the deck 2, the mattress 3 bulges upwardly to form a crown with a convex plane or surface 2*a*. As noted above, the sofa bed cushions cannot lie flat on a crowned surface. This provides both an unsightly appearance and an uncomfortable seat.

Figure 7:
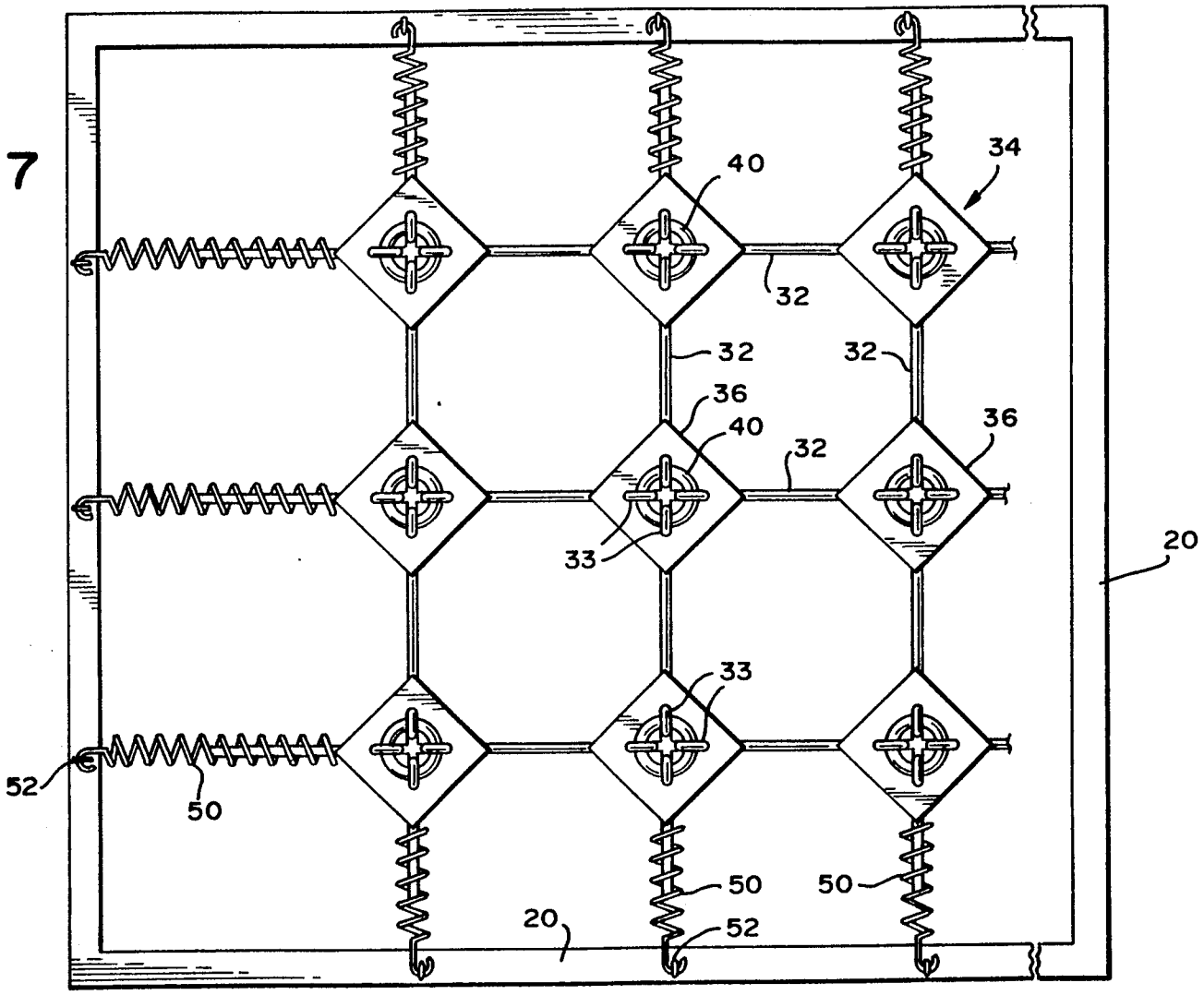
FIG. 7 is an enlarged plan view of the deck with portions broken away showing the upper side of the deck as seen when the sofa bed is in the bed mode.
Figure 8:
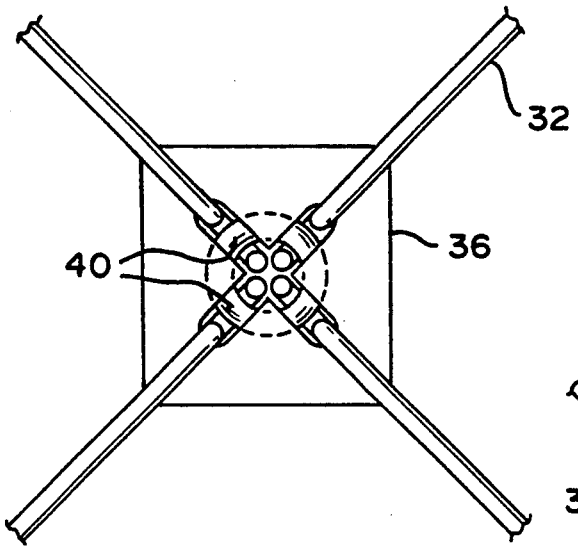
FIG. 8 is a fragmental plan view of a joint corresponding to the view shown in FIG. 6.
Figure 9:
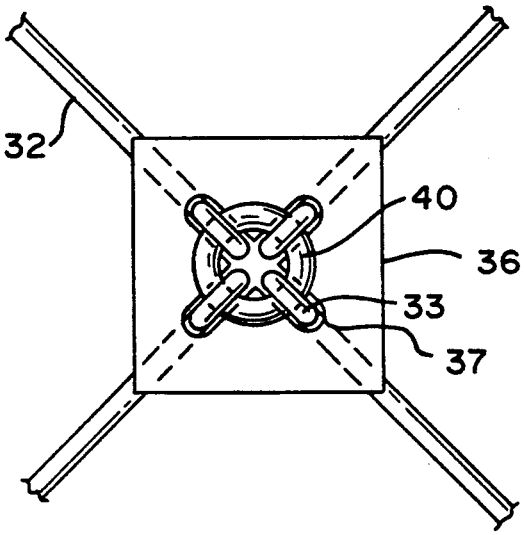
FIG. 9 is a plan view of the joint of FIG. 8 but as seen from the opposite side thereof.

The above problems are solved by the unique deck of the present invention which in the preferred embodiment may include any suitable perimeter frame 20 made from wood, tubular metal or any other suitable materials; the frame being shown as rectangular in FIG. 7. The deck includes a plurality of wire or wire-like members 32 which in the shown embodiment have descrete lengths of about 5¼ inches and are arranged in a grid which in the shown embodiment is a rectangular grid.

In accordance with the present invention, the adjacent ends of the wires 32 where their paths would intersect if extended, are connected by or through means which allow the wires 32 to yield or pivot when loaded or forced from one side but which will prevent the wires from pivoting or yielding when forced or loaded from the opposite side. The deck is arranged in the sofa bed such that when the sofa bed is in the bed position, the deck will not yield in a downward direction under the weight of the mattress or the occupant of the mattress but rather would provide a sturdy flat planar support structure. However, when the deck is moved into the sofa position and part of the deck at the remote end is folded with the mattress into the overlying position represented by 12*a* in FIG. 2, that portion of the deck will yield downwardly under the weight of the occupant of the sofa as is desirable to provide a soft and comfortable seat, but at the same time that portion of the deck will not be movable upwardly into a crowned or convex position under forces from the mattress, but rather will remain in a generally horizontal position as shown in FIG. 2. This not only provides a comfortable seating surface but also allows the sofa cushions to be placed on the deck so that they lie flat on the deck rather than "smile".

Figure 10:
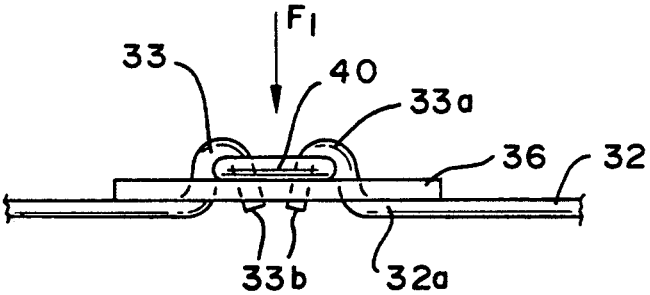
FIG. 10 is a cross-sectional view of the front as shown in FIG. 9.

In one preferred embodiment of the invention, the deck wires 32 are joined by a connecting element 36 shown as a rectangular plate which is made from a suitable material such as steel and having a plurality of apertures respectively receiving the ends of the wires 32 which in the specific embodiment are shown as having hook shapes 33. Moreover, in the specific embodiment shown, the apertures in the connecting member 36 are formed by a cruciform aperture having four sections respectively receiving the hook portions 33 such that the straight portion 32*a* (see FIG. 10) of the wire is located on one side of the connecting plate 36 and a bite portion 33*a* is located on the opposite side of the connecting plate 36. The hook portions 33 of the wires 32 are retained in position relative to each other and to the connecting plate 36 by means of a retaining member which in the shown embodiment is a ring or ring-like structure 40 which is shown in FIG. 10 as lying on one side of the connecting plate 36. The bite portion 33*a* of the hooked ends 33 of the wires 32 are received about the retainer 40 and with the extremity 33*b* extending below the retainer 40 and through the cruciform slot 40 as shown in FIG. 10. It will thus be seen that if a force such as F1 in FIG. 10 is applied to the joint, the wires 32*a* will not pivot downwardly about the retaining rings 40. This orientation of the wires and their joints as shown in FIG. 10 is utilized for the bed position of the deck to provide a substantially rigid planar support surface for the mattress.

Figure 11:
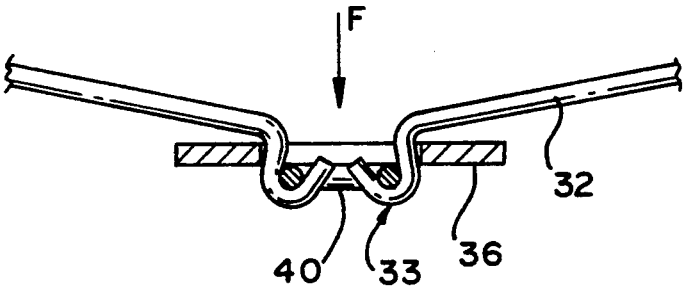
FIG. 11 is a view generally similar to FIG. 10 but with the joint in stressed condition.

Referring to FIG. 11, if a force F is applied to the joints from the side opposite the force F1 described above, it will be seen that the wires 32 will be free to pivot relative to the connecting plates 36 and the retaining ring 40 to allow the joints and the wires to yield, thus providing a soft comfortable seating surface when in the sofa position, shown for example in FIG. 5. In that position which is also shown in FIG. 2, the upper top layer 12*a* of the deck shown in FIG. 2 will be free to yield downwardly to provide a soft seat while the lower layer of the deck will be unyieldable to provide a substantially rigid planar support.

The wire grid of the deck of the present invention may be attached to the frame 20 in any suitable manner; one being shown in FIG. 7 where coil compression springs 50 have one of their ends 52 secured to the frame 20 while their other ends are received in one of the sections of the cruciform slots 37 of the connecting members. It should be understood that although a certain amount of flexability or yieldability in the grid structure will result from the elongation or flexing of the coil springs 50 upon loading, the joints of the wires 32 will still be relatively unyieldable when forces are applied in one direction as described above.

Figure 12:
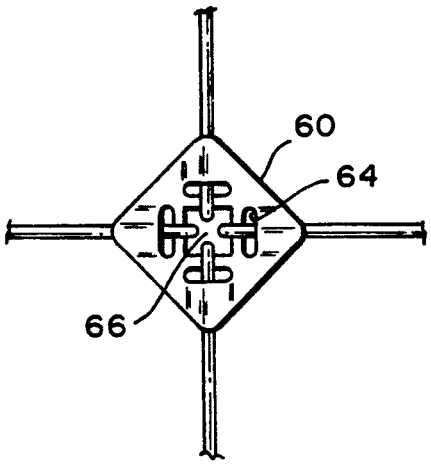
FIG. 12 is a plan view of a joint in accordance with another embodiment of the present invention.
Figure 13:
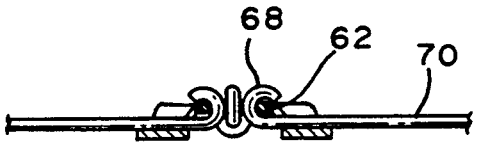
FIG. 13 is a cross-sectional view of the joint shown in FIG. 12.

Although one specific means for interconnecting the grid wires 32 to carry out the invention has been shown and described above, other means may be employed within the scope of the present invention. For example, with reference to FIGS. 12 and 13, a connecting plate 60 may be provided with upstanding portions 62 spaced from the plane of the plates 60 to provide apertures 64 which will receive the grid wires 70 with the hook portions 68 of the wires extending about the offset portions 62 as best shown in FIG. 13. Connecting plate 60 would also be provided with a central aperture 66 through which the hooked wire portions 68 would extend. In addition to the connecting member 60 shown in FIGS. 12 and 13, other means may be employed including connecting the ends of the grid wires to each other directly.

In the specific embodiment shown and described, the grid wires 32 may be made from spring wire. In addition the retaining rings 40 may have a diameter of about ⅝ of an inch. Connecting plates 36 may be 1½ inch squares with slots 37 1¼ inches in length. Obviously other sizes and shapes may also be employed. The wire grid including the joints described above may extend throughout the length and width of the deck frame 20 or only a portion of the deck. The deck support of the invention may also be employed internally to form a support in a box spring. It may also be made without a foldable frame, that is, for a mattress or seat that does not fold as disclosed above.

Although Applicant has shown and described a specific embodiment of the invention, various modifications will become apparent to those skilled in the art but without departing from the scope of the present invention which is indicated in the appendant claims.

I claim:

1. A deck for seating or bedding comprising a plurality of wire-like members extending along intersecting paths and being interconnected at joints, said joints each including means allowing the joints to yield in one direction when forces are applied to the deck in said one direction and preventing yielding of said joints when forces are applied in a second direction opposite said first direction, and wherein said joints each include a connecting member having apertures receiving ends of the wire-like members and a retaining means on one side of said connecting member, said ends of the wire-like members being received about said retaining means.

2. Deck defined in claim 1 wherein the ends of the wire-like members are pivotable about the retaining means to yield in said one direction and wherein the connecting member prevents pivotal movement of the ends of the wire-like members about the retaining means to prevent yielding of said joints when forces are applied in said second direction.

3. The deck defined in claim 1 wherein said retaining means is a ring-like member.

4. The deck defined in claim 1 wherein said retaining means is a portion of said connecting member offset from a plane of the connecting member.

5. The deck defined in claim 1 wherein said ends of the wire-like members are hook shaped.

6. The deck defined in claim 1 wherein said connecting members are plates.

7. The deck defined in claim 1 wherein said ends of the wire-like members are angularly spaced about said retaining means.

8. The deck defined in claim 7 wherein said ends are pivotable about said retaining means to yield in said one direction.

9. A deck for seating or bedding comprising a plurality of wire-like members extending along intersecting paths to form a grid, said grid including a plurality of said wire-like members having adjacent ends and means interconnecting said ends while preventing movement of said ends in one direction and allowing movement of said ends in a direction opposite said one direction.

10. The deck defined in claim 9 wherein the deck has four wire-like members whose ends are connected by said means.

11. The deck defined in claim 10 wherein said ends are angularly spaced from each other.

12. In a sofa bed having a frame movable between a folded position for sofa use and an unfolded position for bed use, said frame including a deck for supporting bedding, said deck having an end portion adapted to overly bedding when the frame is in the folded position and to underly bedding when the frame is in the unfolded position, said deck portion being yieldable in a downward direction and relatively unyieldable in an upward direction when the frame is in the folded position.

13. The sofa bed defined in claim 12 wherein said wire-like members are connected to each other at joints and wherein there is included means preventing movement of the wire-like members at the joints when forces are applied to the joints in said upward direction when the frame is in the folded position.

14. The sofa bed defined in claim 12 wherein said deck includes a plurality of individual wire-like members and means interconnecting adjacent ends of said members while allowing movement of said ends in one direction and preventing movement of said ends in an opposite direction.

15. A method of providing a firm bedding support while at the same time preventing upward bulging of the bedding in a sofa bed having a bedding support frame comprising the steps of constructing a deck within the bedding support frame to be yieldable in one direction and relatively unyieldable in another direction opposite said one direction, and arranging the deck such that when in extended position for use as a bed the deck will be relatively unyieldable downwardly and when in a folded position for use as a sofa, the deck will have a portion overlying the bedding while being relatively unyieldable upwardly but yieldable downwardly.

* * * * *